US007896719B2

(12) United States Patent
Rayles et al.

(10) Patent No.: US 7,896,719 B2
(45) Date of Patent: Mar. 1, 2011

(54) MARINE SURVIVAL SYSTEM

(76) Inventors: Victoria L. Rayles, San Francisco, CA (US); Ronald Rayles, Gardner, MA (US)

( * ) Notice: Subject to any disclaimer, the term of this patent is extended or adjusted under 35 U.S.C. 154(b) by 155 days.

(21) Appl. No.: 11/890,145

(22) Filed: Aug. 2, 2007

(65) Prior Publication Data

US 2008/0280516 A1 Nov. 13, 2008

Related U.S. Application Data

(60) Provisional application No. 60/835,174, filed on Aug. 3, 2006.

(51) Int. Cl.
*B63C 9/00* (2006.01)

(52) U.S. Cl. ..... 441/80; 441/84

(58) Field of Classification Search ..... 441/80, 441/81, 84, 85, 88; 224/191; 405/185, 186, 405/187

See application file for complete search history.

(56) References Cited

U.S. PATENT DOCUMENTS 3,387,698 A * 6/1968 Hendricks et al. ..... 206/573
3,696,453 A * 10/1972 Harris et al. ..... 441/80
5,234,144 A * 8/1993 Iler ..... 224/191
5,839,932 A * 11/1998 Pierce et al. ..... 441/80
6,659,689 B1 * 12/2003 Courtney et al. ..... 405/186

FOREIGN PATENT DOCUMENTS

GB BR 1514372 A * 6/1978

* cited by examiner

*Primary Examiner*—Lars A Olson

(57) ABSTRACT

Use of the present invention allows a crew member who has suffered a marine emergency, for example, fallen overboard or had to abandon ship, to survive for an extended period of time by providing the tools and equipment found in commercial survival systems yet does so at an economical cost. The system of the present invention includes a package that may be easily attached to a round buoy/life ring, horseshoe buoy, life vest or, alternatively, stored in a standalone manner. The system of the present invention has a number of features of more expensive survival systems including a life raft, both manual and electronic signaling equipment, basic survival tools including a water collector, knife and first aid kit, as well as other items not usually found in such systems. Additionally, the survival system of the present invention advantageously provides an attachment mechanism such that in adverse conditions the various components of the system are kept together.

10 Claims, 7 Drawing Sheets

MARINE SURVIVAL SYSTEM

This non-provisional patent application claims the benefit of the earlier filed U.S. provisional patent application 60/835,174, filed Aug. 3, 2006.

BRIEF DESCRIPTION

The subject of this invention relates to the marine transportation industry. Specifically, this invention concerns an improved system for surviving an at-sea emergency where a crew member has fallen overboard. The system of the present invention provides the crew member with an expanded set of survival tools and equipment when compared with the existing art.

BACKGROUND OF THE INVENTION

The marine transportation industry includes both commercial and recreational water-craft. Whether a small day-sailer or super tanker, one common hazard to all mariners is the risk of falling overboard and not being able to get back to the craft. In many situations, even though the crew of the craft recognizes that a crew member has fallen overboard, it is impossible to get to them for a rescue attempt. The farther away from shore, the worse the situation. Once the shoreline is lost it is difficult to determine in which direction to seek rescue. Under stormy or nighttime conditions 5, the problem is further exacerbated.

Over time many tools and methods have been developed to increase the survivability of an overboard crew member. These include the life ring, the horseshoe buoy, self contained packages such as a plastic cylinder containing survival gear, and others. Each of these is deployed in the direction of the person who has gone overboard in the hope that it will sustain them until the craft can turn and perform the rescue. Unfortunately, as is known, many times the overboard crew member cannot be found due to a number or possible problems including rough seas, poor visibility, and others. If the crew member can be found, they can be brought back aboard. If not, the crew member is on their own for survival until such time as a search can be mounted.

Supposing that an overboard crew member has not been found, there are numerous disadvantages to the present survival tools. The life ring or horseshoe buoy alone will keep a person afloat, but has no facility for keeping the crew member dry and warm. This opens the door to hypothermia, thirst and other threats that severely diminish the chance of survival.

There are products that increase the likelihood of survival, at least for short periods. These include prepackaged kits containing such items as a mirror, a flashlight, a whistle and other items such as nutritional bars and first aid supplies. While superior to a simple life ring, these products still lack the ability to keep the person warm and dry, thus exposing them to the same risks as described above. Further, in some cases the items contained in the rescue kit are not attached to the container and are lost due to the physical and environmental conditions at the time the items are needed.

Still other products are available that solve the problems of the simpler methods discussed just above. These include a life raft, signal flares, a greater supply of nutrition and fresh water allowing one or more crew members to remain alive for an extended period of time. However, these products are very expensive, bulky and are generally found on commercial vessels and large pleasure craft. The sheer size and weight of these survival systems disqualifies them for use on smaller craft.

What would be desirable is a relatively low cost product that performs in the same way as the more expensive products and is small enough to be used on even very small craft. Moreover, if such a product could be adapted to existing methods, for example, to a life ring or horseshoe buoy, convenience and cost savings could be realized.

SUMMARY OF THE INVENTION

Use of the present invention allows a crew member who has suffered a marine emergency, for example, fallen overboard or had to abandon ship, to survive for an extended period of time by providing the tools and equipment found in commercial survival systems yet does so at an economical cost. The system of the present invention includes a package that may be easily attached to a round buoy/life ring, horseshoe buoy, life vest or, alternatively, stored in a standalone manner. The system of the present invention has a number of features of more expensive survival systems including a life raft, both manual and electronic signaling equipment, basic survival tools including a water collector, knife and first aid kit, as well as other items not usually found in such systems. Additionally, the survival system of the present invention advantageously provides an attachment mechanism such that in adverse conditions the various components of the system are kept together.

The package of the present invention provides the user with a novel method for attaching the improved marine survival system to a life vest, a round buoy/life ring or horseshoe buoy. The high visibility fabric enclosure has a pair of adjustable straps attached on opposing sides that are capable of passing around the round buoy/life ring or horseshoe buoy thereby fixing the two together. In an emergency, tossing the ring or buoy to the person who has gone overboard provides both immediate flotation and, if necessary, longer term survival supplies contained within the sealed pack of the present invention. While the exact contents of the sealed pack vary depending on the type of offshore activity, in a preferred embodiment the survival supplies are capable of extending the survival envelope to weeks instead of days.

A second feature of the present invention is that the package and all the contents are initially tethered together. This is very important since, in emergency situations, the conditions at the time of the emergency may not be conducive to gathering the various components needed to survive together, for example, poor visibility, rough seas or both. Once the person has gotten hold of the ring or buoy, or the package itself if it was stored in a standalone manner, it may be quickly tethered to an arm or leg so that it will not drift away as the person organizes their survival activities. Since the individual components of the system contained within the package are initially tethered together, even if the package is accidentally opened the critical survival components will not be lost.

A third feature of the present invention is the presence of a single person life raft. Once the package has been opened the contents may be removed and, since they are tethered, the person need not worry about individual components drifting out of reach. The life raft may be inflated and the balance of the contents placed inside along with the person. The ability of a person to enter a sheltered environment significantly increases their chances of survival because it allows the person to avoid or delay the onset of hypothermia and exposure.

These and other objects and advantages of the present invention are discussed below in conjunction with FIGS. 1 to 6.

DETAILED DESCRIPTION OF PREFERRED EMBODIMENTS

As described briefly above, the improved marine survival system of the present invention is capable of being operated by a single user and extends the survival time and enhances the chances for rescue for a person who has fallen overboard at sea. The survival time is extended by providing an expanded set of survival tools when compared to existing art. This expanded set of tools includes a one-man life raft, manual and electronic signaling equipment, navigation tools, basic survival tools such as food, water, knife and first aid kit, as well as other items such as an instruction manual to assist an inexperienced person in the survival process.

Figure 1:
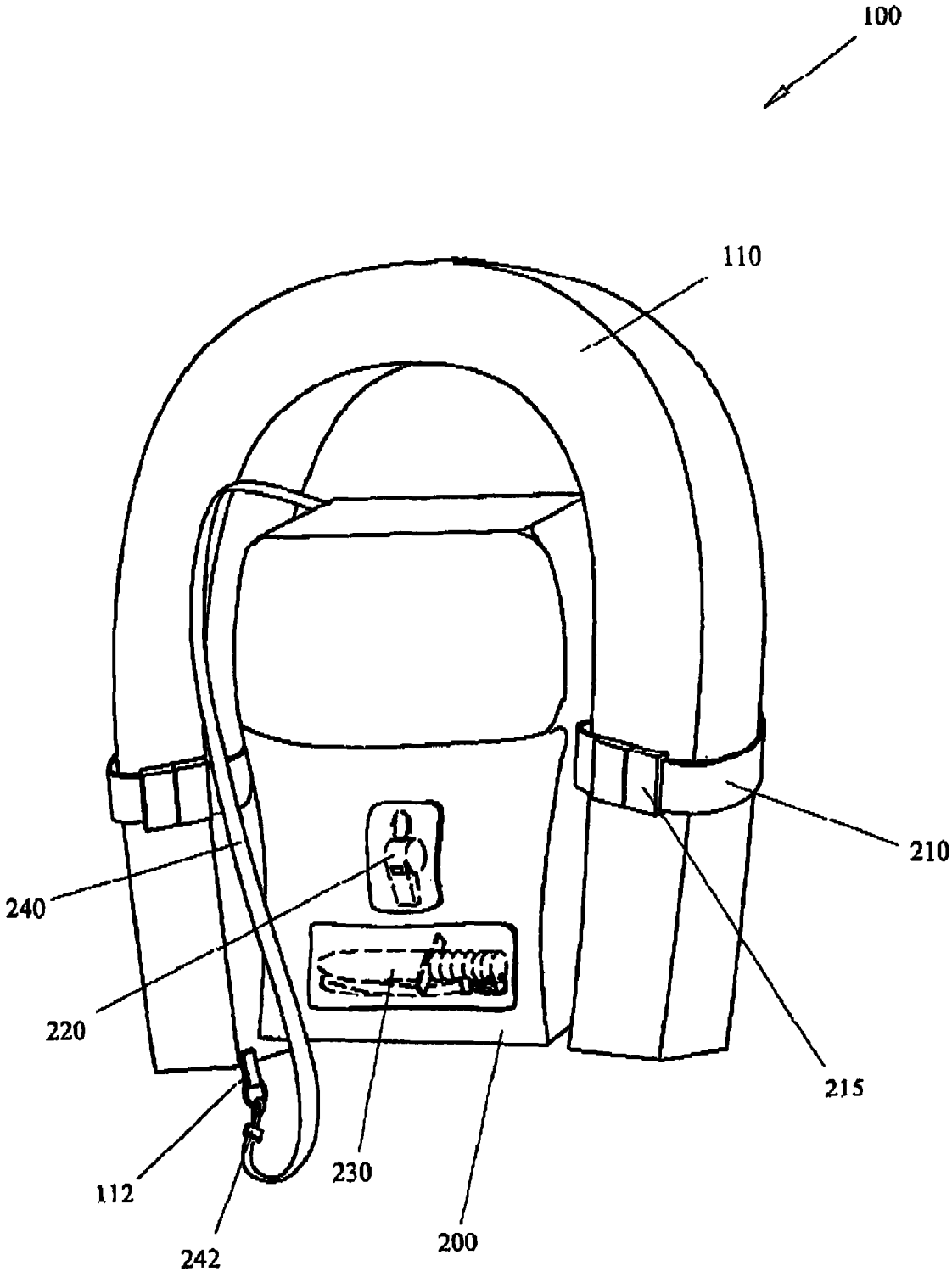
FIG. 1: is a view of the improved marine survival system of the present invention attached to a horseshoe buoy.

Looking at FIG. 1, an overview 100 of the improved marine survival system 200 of the present invention is shown attached to a floatation device 110, in this case a horseshoe buoy of the type commonly found on offshore pleasure craft. The improved marine survival system 200 is attached to floatation device 110 by straps 210 and buckles 215 (one on either side). Note that although the improved marine survival system 200 of the present invention is shown attached to a horseshoe buoy 110, it may just as easily be attached to a different type of floatation device, for example, a standard round buoy/life ring or a life vest, in a similar manner or, alternatively, be stored in a standalone manner. If the improved marine survival system 200 is stored in a standalone manner, for example, by attachment to a stanchion or life line, a bracket for that purpose is provided. Brackets of the type used are common in the art and thus is not shown for clarity, but this should not be read as a limitation on the scope of the invention.

Also, while the marine survival system of the present invention uses buckles 215 to attach the straps 210 to a floatation device 110, other attachment mechanisms could be used without departing from the spirit of the invention. By way of example, but not a limitation, the straps 210 could be fastened to the floatation device 110 by hook-and-loop fasteners. Main tether 240, discussed in detail below, attaches to both the interior of the marine survival system 200 and to a tab 112 on the floatation device and is used to prevent the marine survival system 200 from drifting away while the user is concentrating on putting on the floatation device 110. In another alternative tethering method, main tether 240 has a hook-and-loop method such as that discussed just above.

In a marine emergency one of the very first activities is to attempt to provide a physical location for the person overboard. For this reason, whistle 220 is mounted beneath a flap on the outside of the sealed pack 200 (discussed in detail below in conjunction with FIG. 7) for instant access. Also located under a flap on the outside of the sealed pack 200 for generally the same reason is the survival knife 230. Each of these items is sub-tethered to the sealed pack 200 such that they will not float away during an emergent situation.

Figure 2:
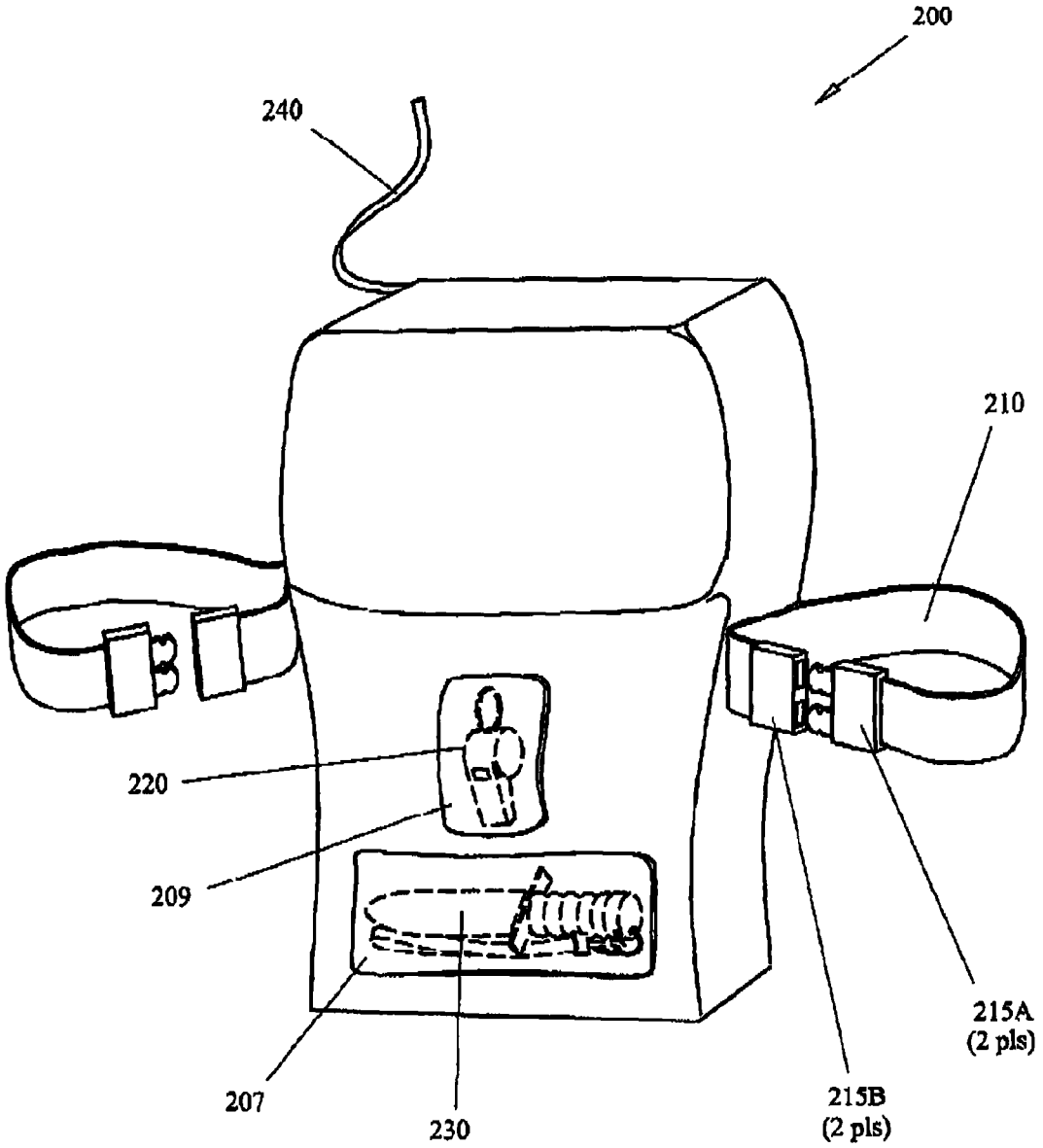
FIG. 2: is a view of the survival system of the present invention showing the attaching straps.

Referring now to FIG. 2, the improved marine survival system 200 is shown in the detached state. The straps 210 are shown with the buckles 215A and 215B in the unbuckled state. As mentioned just above, main tether 240 is attached to a floatation device (not shown). As a first line of rescue, a whistle 220 is mounted underneath flap 209 on the outside of the sealed pack as a means of rapidly indicating the user's location. Additionally, a survival knife 230 is mounted underneath flap 207 on the outside of the sealed pack to enable rapid access for use, for example, in cutting tangled lines. In a preferred embodiment both flaps 207 and 209 use a hook-and-loop sealing method.

Figure 3:
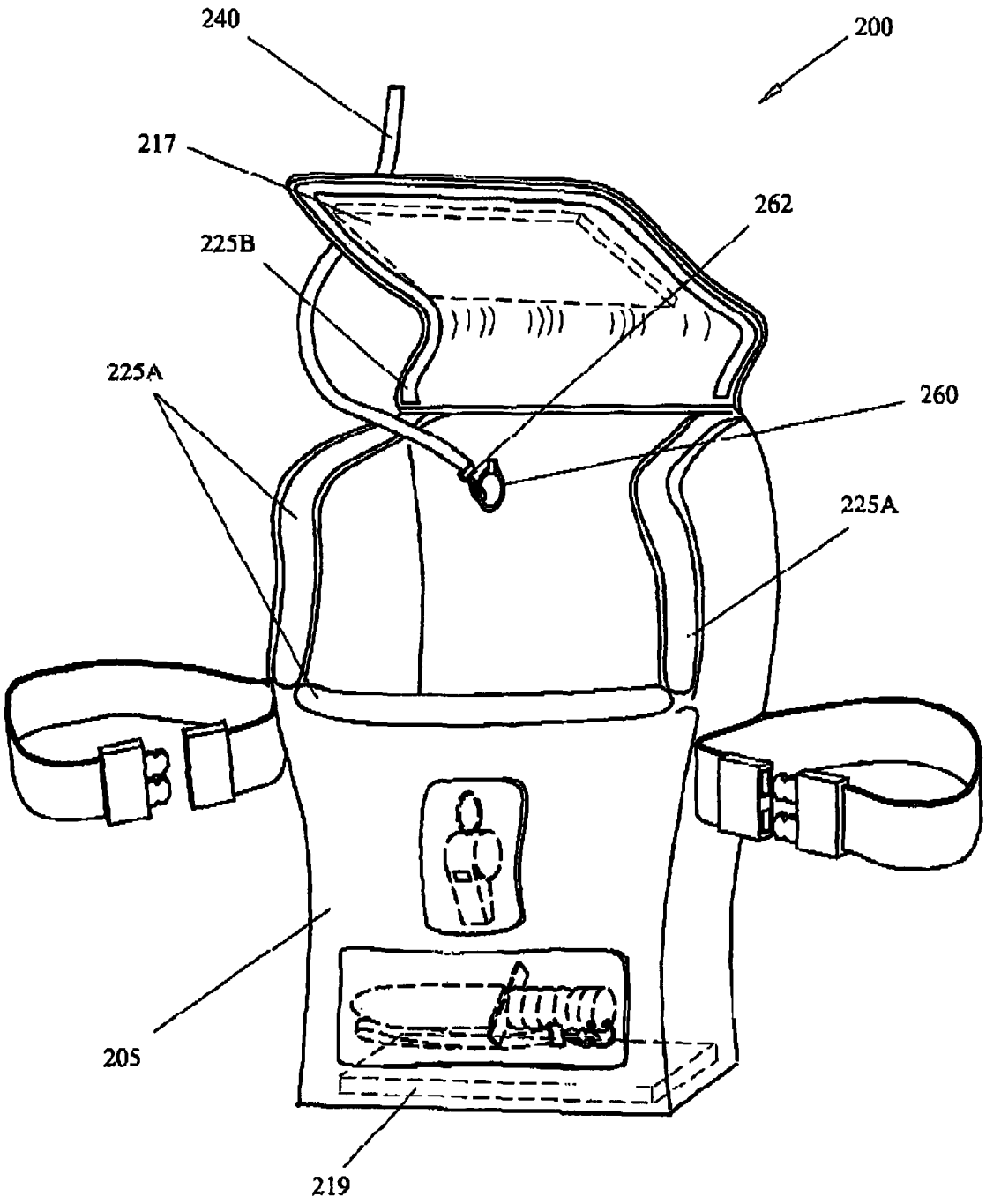
FIG. 3: is a view of the improved marine survival system of the present invention showing the top open for access to the survival material components inside.

Looking at FIG. 3, the improved marine survival system 200 is shown with the sealed pack 205 open and the marine survival components removed. In a first embodiment, the sealed pack 205 is sealed closed using a hook-and-loop fastener such as Velcro® (Velcro Industries B.V., Willemstadt, Curacao, Netherlands Antilles) hook-and-loop type mechanism comprised of hook strips 225A and loop strips 225B, however, it will be recognized that other closure mechanisms could be used without departing from the scope of the invention. The sealed pack 205 is made of a high brightness lightweight material such as red nylon however, it will be recognized that other color/material combinations could be used without departing from the scope of the invention. The top and bottom panels of the sealed pack 205 have closed cell foam flotation sections 217 and 219 respectively inserted. The purpose of closed cell foam flotation sections 217 and 219 is to provide buoyancy to the sealed pack 205 so that the user does not have to expend effort keeping it afloat.

The main tether 240 is shown in detail in FIG. 3. In a preferred embodiment main tether 240 is made from ¾ inch nylon strap and is fastened to the interior of the sealed pack 205 of the marine survival system 200 by means of snap hook 262 and ring 260. The opposite end of the main tether is wrapped around a floatation device, for example a horseshoe buoy, and fastened with a hook-and-loop fastener. The length of main tether 240 in a preferred embodiment is approximately 48 inches. The purpose for selecting this length is to be long enough to allow the user to have the necessary freedom to get into the floatation device, but short enough so as not to become tangled in the user's legs and arms during an emergency situation.

Figure 4:
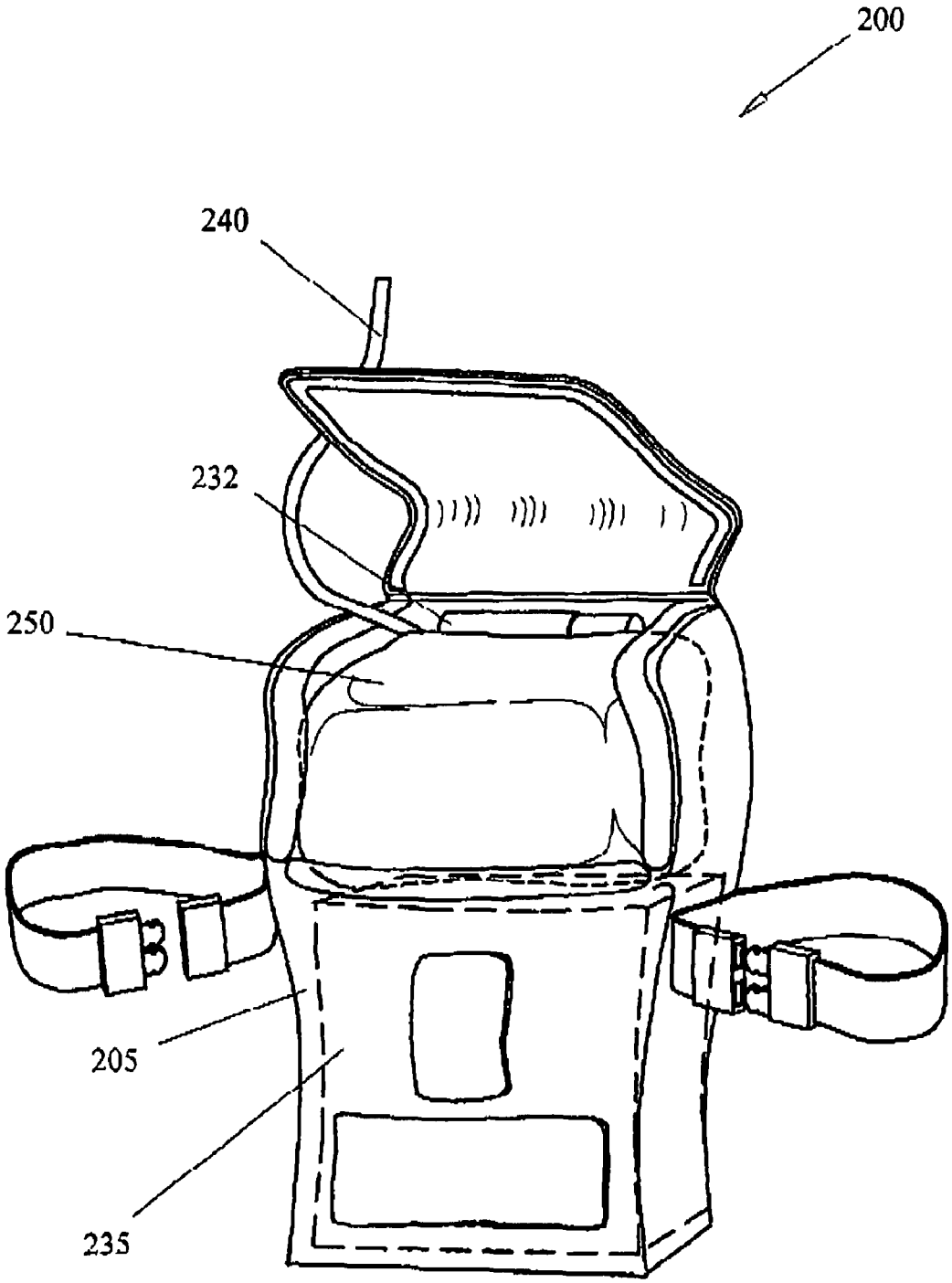
FIG. 4: is a view of the improved marine survival system of the present invention showing the system in the packed state.

FIG. 4 again shows the improved marine survival system 200 in the open state but also shown is the relationship between the major marine survival components of the sealed pack 205. A utility pack 235 occupies the bottom of the sealed pack 205, followed by a one person life raft 250 and finally an emergency locating flare 232. In a preferred embodiment a signal mirror and a strobe light are also attached to the same sub-tether as the emergency locating flare 232. Note that each of these items is attached to the interior of the sealed pack 205 with a short sub-tether (not shown in this view, but discussed in detail below) so that once opened the contents cannot drift away. The main pack 200 has a leg strap (not shown for clarity) that, once removed from the top of the pack, may be used to quickly affix the entire improved marine survival system 200 to the user so that it will not be lost in the confusion of a marine emergency.

Figure 5:
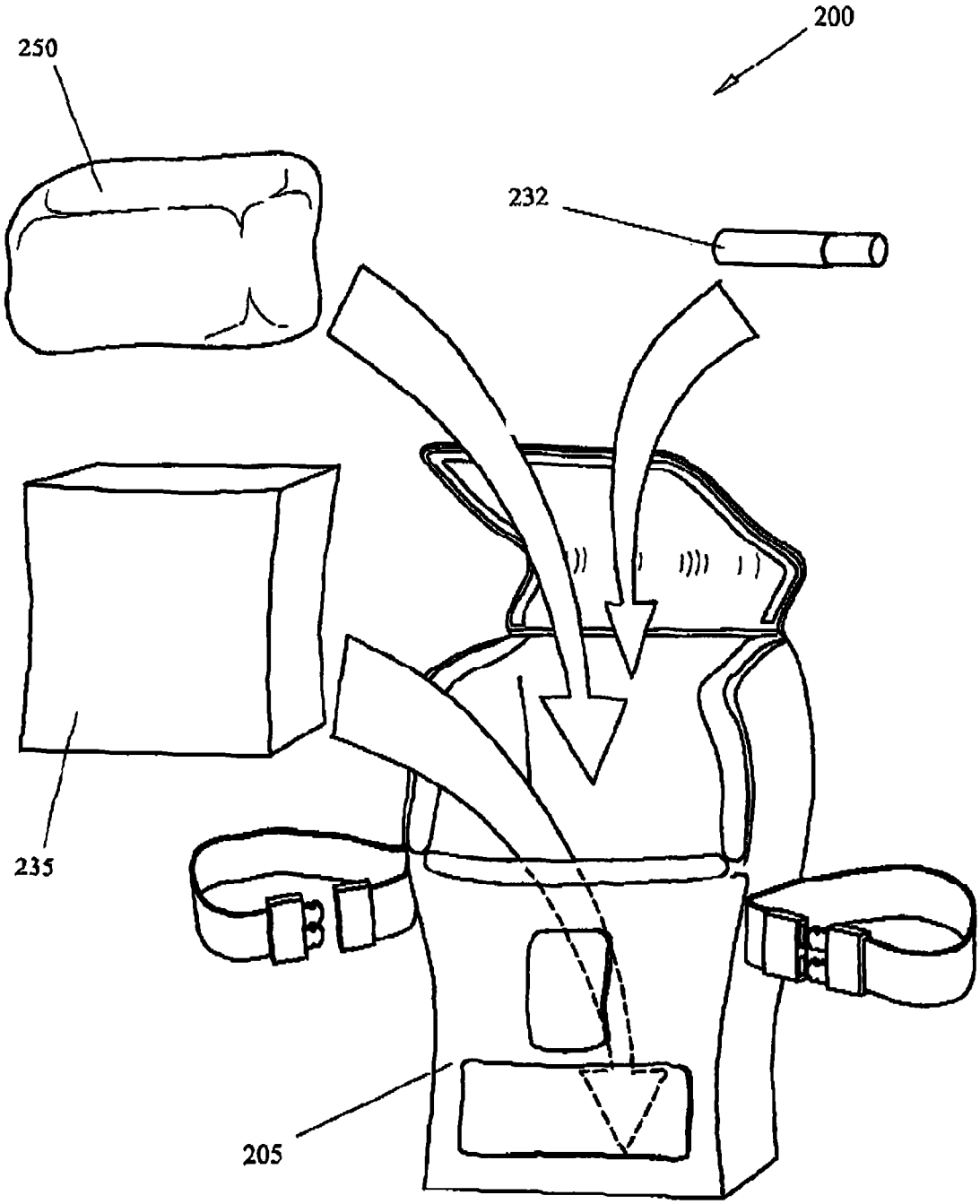
FIG. 5: is a view of the improved marine survival system of the present invention showing how the separate marine survival components of the system are placed in the package.

FIG. 5 provides the details of the packing of the improved marine safety system 200. The utility pack 235 is placed in the sealed pack 205 first, followed by the one person life raft 250 and the flare 232. The utility pack 235 contains the balance of the marine survival tools and supplies as discussed above. In a first embodiment of the present invention the one person life raft 250 is a manually inflated type, but in an alternative embodiment the raft is of the self inflating type. It will be recognized by those skilled in the art that not all of the items need be present in order to enable the invention. For example, the improved marine survival system 200 of the present invention may not have the one man life raft 250 but will still use the attachment and tether methods of the invention for the remaining components.

Advantageously, the specific items included in the utility pack 235 can be varied depending on the choices the user makes. In a preferred embodiment of the present invention the marine survival components consist of a first aid kit, a mirror, a GPS locating device, a flashlight, nutritional bars/food, water packets, a space blanket, a portable fresh water making apparatus, a radio locator beacon, a hand held transceiver, and an instruction manual. Each of these components works in the customary manner, thus no attempt is made to discuss their operation in detail to aid in clarity. It will be recognized by those skilled in the art that these are not the only possible components and that altering the exact components does not impact the novelty of the present invention.

Figure 6:
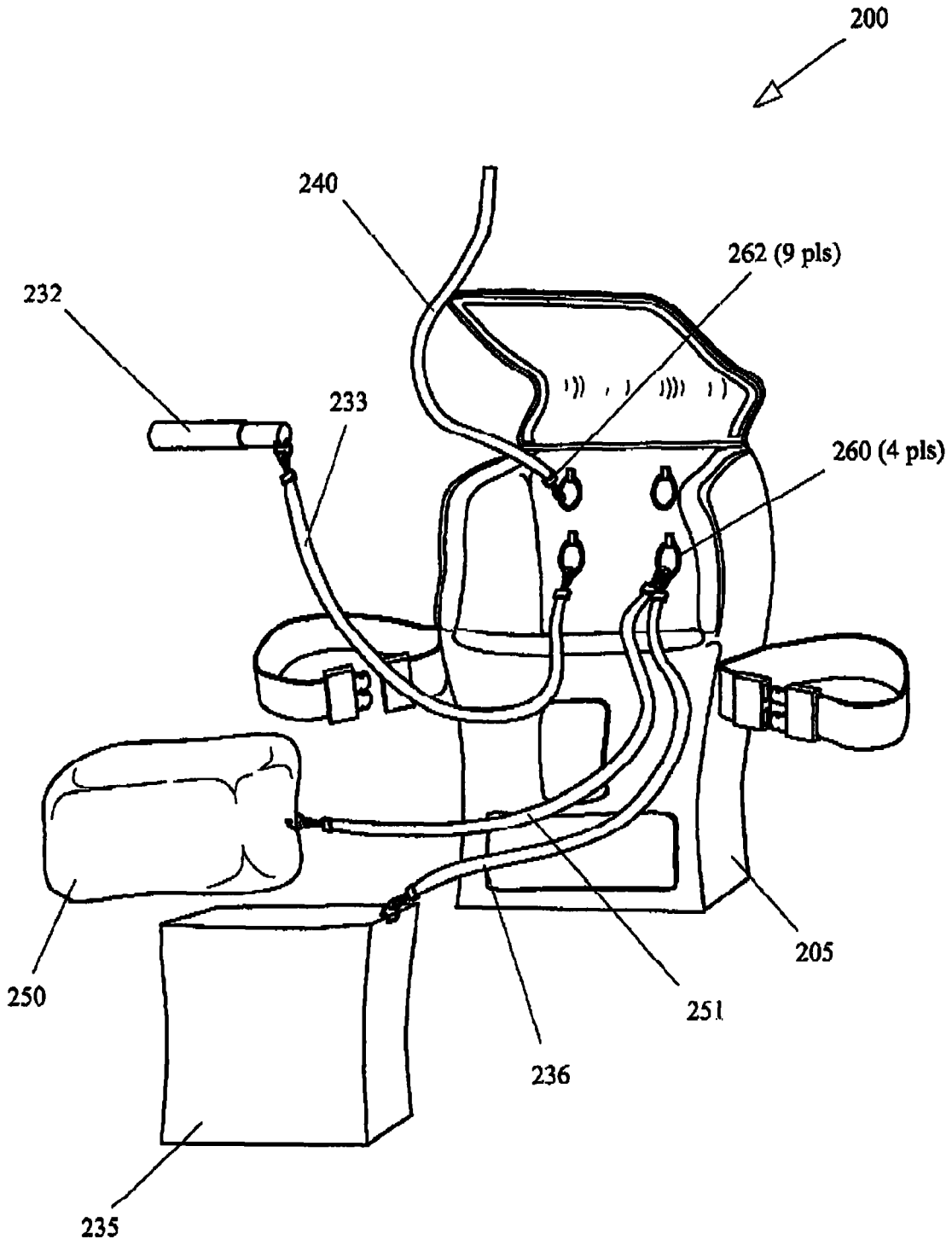
FIG. 6: is a view of the marine survival component tethering mechanism of the improved marine survival system of the present invention.

Turning now to FIG. 6, the marine survival system 200 of the present invention is shown again, but in this view the details of the tethering mechanism are shown. The interior of the sealed pack 205 has a series of rings 260 attached to the back. Note that while the rings 260 are attached to the back of sealed pack 205, they could just as easily be attached on any interior surface without departing from the spirit of the invention, thus the location of the rings in the preferred embodiment should not be read as a limitation on the scope of the invention. In a preferred embodiment four rings 260 are used, but more or fewer rings could be used without departing from the spirit of the invention. Each of the individual marine survival components are attached to the sealed pack 205 by means of a separate sub-tether and snap hook. In a preferred embodiment each of the sub-tethers discussed below is made from a 24 inch length of ¾ inch nylon strap. The length was chosen to allow enough separation of components without the danger of tangling in an emergency situation. A snap hook 262 is located at either end to allow a component to be quickly attached or detached. In a preferred embodiment the snap hooks are made of plastic, but they could just as easily be made from some other material, for example, stainless steel, without departing from the spirit of the invention.

Starting at the upper left the emergency locator flare 232 is attached to the sealed pack 205 by means of sub-tether 233. Recall that as well as the emergency locator flare 232, sub-tether 233 may also have attached a signal mirror and/or a strobe light. The one man life raft 250 is attached to the sealed pack 205 by means of sub-tether 251 and the utility pack 235 is attached to the sealed pack 205 by means of sub-tether 236. The main tether 240 used to attach the sealed pack 205 to a flotation device attaches to the sealed pack 205 in the same manner as each of the components. Each of the components is attached to one of the rings 260 attached to the interior of the sealed pack 205. It will recognized that more or fewer survival components could be tethered to the sealed pack 205 in this way, thus the presence of the exemplary components should not be read as a limitation on the scope of the invention.

Figure 7:
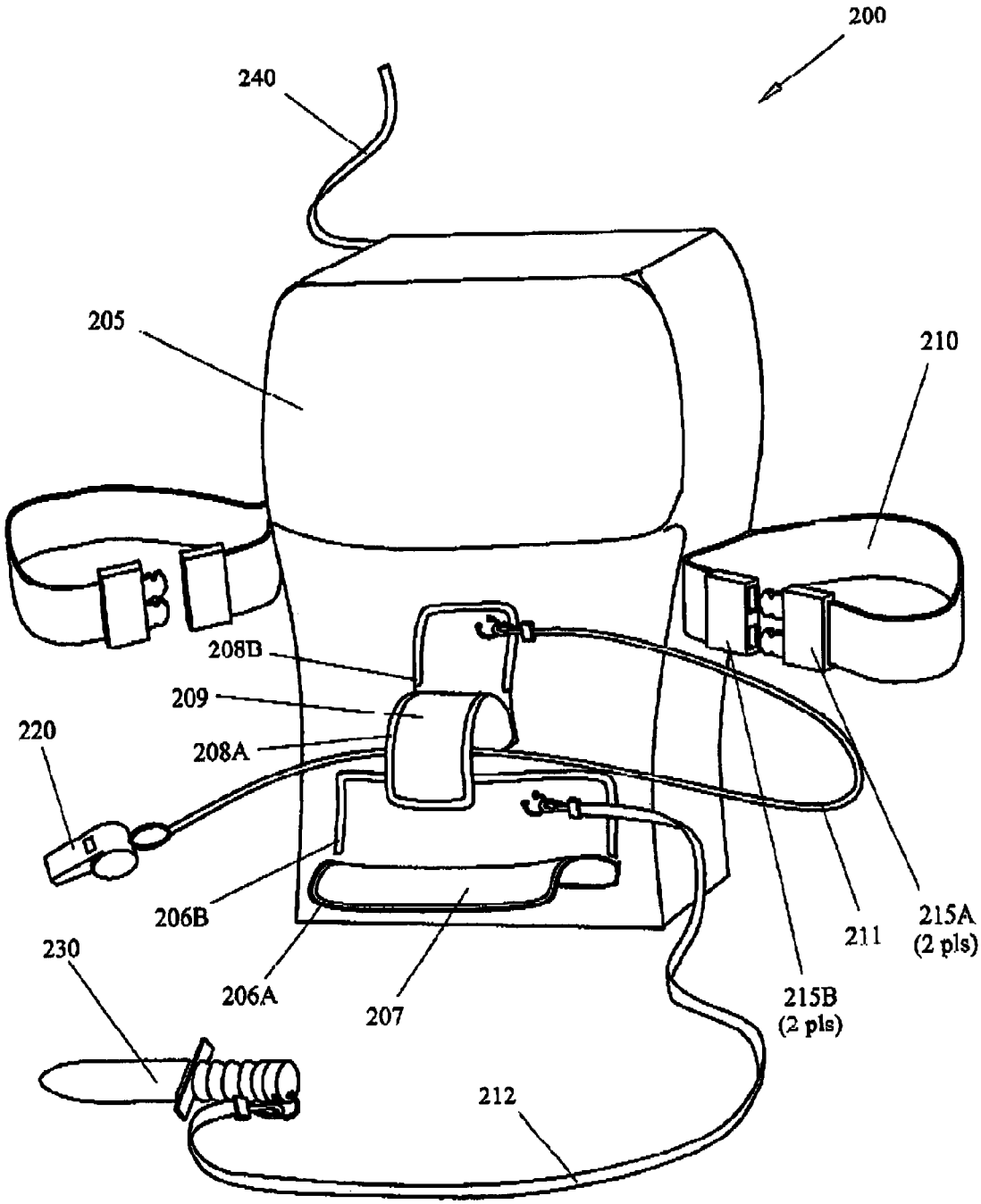
FIG. 7: is a view of the marine survival system with the survival knife and whistle deployed.

Looking now at FIG. 7, in an emergency, the floatation device with the marine survival system 200 attached is thrown overboard in the direction of the crew member, or alternatively, thrown overboard by the user in a single person emergency. Since the craft from which the crew member fell will continue on, the crew member becomes the user of the system. First, the straps 210 are unbuckled from the sealed pack 205 using buckles 215A and 215B allowing sealed pack 205 to be removed from the floatation device. This can be done since main tether 240 will prevent the sealed pack 205 from drifting away even if the user does not pay attention to it. Once the sealed pack 205 has been cleared from the floatation device the user can put the device on to keep him or her afloat.

Next, the user can use main tether 240 to retrieve the sealed pack 205 and has immediate access to the whistle 220 by pulling flap 209. This may be enough to help the craft to locate the user and effect a rescue. In a preferred embodiment flap 209 is sealed closed using hook strip 208A and loop strip 208B. Sub-tether 211 insures that the whistle 220 will not be lost and is attached in the same way as discussed above in conjunction with FIG. 6. However, in the case of whistle 220, the sub-tether 211 in a preferred embodiment is made of ⅛ inch nylon cord for both space and weight efficiency.

Supposing that the craft was unable to locate the user, the user must now take steps to insure survival. The main tether 240 may be removed from the floatation device and immediately attached to the user using the same hook-and-loop mechanism that was used to secure the sealed pack 205 to the floatation device to insure that the sealed pack 205 does not drift away. However, as described briefly above, a separate leg strap (not shown for clarity) is provided that allows attachment of the sealed pack 205 to the user prior to disengaging the sealed pack 205 from the floatation device. This separate leg strap uses a hook-and-loop method and is, in general, identical to the tethers discussed above, thus the fact that the separate tether is not shown should not be read as a limitation on the scope of the invention.

Should the situation demand it, the survival knife 230 can be quickly accessed by pulling on flap 207. This may be necessary, for example, if the user needs to free himself or herself from lines that have washed overboard. In a preferred embodiment flap 207 is sealed closed using hook strip 206A and loop strip 206B. Sub-tether 212 insures that the knife 230 will not be lost and is attached in the same way as discussed above in conjunction with FIG. 6.

Once done the user opens the sealed pack 205 and removes the marine survival components. Since each of these components is attached to the interior of the sealed pack 205 there is no danger that they will drift away. Depending on the situation, the user may choose to ignite the emergency location flare 232 or, alternatively, inflate the one man life raft 250. In a preferred embodiment of the present invention the one man life raft 250 is automatically inflated using a compressed air source. In an alternate embodiment the life raft 250 is of the manually inflated type.

Supposing that either the user ignited the emergency location flare 232 and the craft did not see it, or that conditions prohibited the craft from even attempting a rescue, using the contents of the improved marine survival system 200 of the present invention the user is able to stabilize his or her situation, create a relatively warm and dry space and has the necessary components to survive for several days or several weeks. This ability gives the user a much higher probability of rescue.

One advantage of the present invention is the ease with which it may be stored and deployed. The improved marine survival system of the present invention may be attached to a flotation device such as a ring buoy, a horseshoe buoy, or a life vest or may be attached in a stand-alone manner to a railing or stanchion.

A second advantage of the present invention is the rapidity with which it may be deployed. Since the sealed pack containing all the required survival components is already attached to a flotation device, it is deployed at the very same time saving valuable seconds for the crew member overboard.

A third advantage of the present invention is the completeness of the kit which includes many more components than other general purpose marine survival kits. If a crew member is overboard and not recovered in very short order, it could be days before a search and rescue effort is able to locate them. Having the spectrum of components of the system of the present invention significantly improves the chances of a rescue.

A fourth advantage of the present invention is that it is economical when compared to commercial type kits making longer term survival available to pleasure craft operators. While marine survival systems with the components needed for longer term survival exist, they are costly and generally limited to commercial craft. The present invention provides a comparable level of survivability for off shore pleasure craft at a reasonable cost.

A fifth advantage of the present invention is that all of the components are tethered to the sealed pack. Thus in an emergent situation, when confusion and disorientation have deleterious effects on a crew member overboard, even if the sealed pack opens all of the survival components will remain. When things settle down the overboard crew member can then retrieve the components and set about the task of surviving.

What is claimed is:

1. An improved single user operated marine emergency extended time survival system the improvement comprising a single easily deployed sealed utility pack wherein survival material components of said sealed pack consist of:

a first exterior compartment containing a whistle, said whistle attached to said sealed pack by means of a first sub-tether;

a second exterior compartment containing a survival knife, said survival knife attached to said sealed pack by means of a second sub-tether;

a utility pack containing survival tools and supplies, said utility pack attached to an interior of said sealed pack by means of a third sub-tether;

a one person life raft, said one person life raft attached to said interior of said sealed pack by means of a fourth sub-tether and;

an emergency locating flare, said emergency locating flare attached to said interior of said sealed pack by means of a fifth sub-tether.

2. The utility pack of claim 1 wherein the contents of the utility pack include;

a first aid kit;
a signal mirror;
a GPS locating device;
a waterproof flashlight;
nutritional bars/food;
water packets;
a space blanket;
a portable fresh water making apparatus;
a radio locator beacon;
a magnifying glass;
a rain catching device;
a set of fishing lines, hooks and lures;
a soft wide brimmed hat;
a pair of sunglasses;
several self-sealing plastic bags;
a hand held transceiver;
suntan lotion;
lip balm;
soap and sponge, and;
an instruction manual.

3. The sealed pack of claim 1 wherein said sealed pack is strapped to a ring buoy floatation device.

4. The sealed pack of claim 1 wherein said sealed pack is strapped to a life vest.

5. The sealed pack of claim 1 wherein said sealed pack is strapped to a railing in a stand-alone manner.

6. The sealed pack of claim 1 wherein a seal of said sealed pack is made from hook-and-loop fasteners.

7. A main tether of claim 1 wherein said main tether is attached to the floatation device by means of a hook-and-loop strap.

8. The one person life raft of claim 1 wherein said one person life raft automatically inflates using a compressed air source.

9. The one person life raft of claim 1 wherein said one person life raft is manually inflated by a user.

10. A method for using an improved single user operated marine emergency extended time survival system, said extended survival time provided by a single person life raft, comprising the steps of:

placing survival material components including said life raft inside a sealed pack, each of said survival material items being sub-tethered to an interior of said sealed pack;

strapping said sealed pack to a flotation device using a pair of straps and further tethering said sealed pack to said flotation device by means of a main tether such that when said flotation device is thrown overboard and said pair of straps are removed said sealed pack is separated from said flotation device without drifting away.

* * * * *